US007377711B2

(12) United States Patent
Byun

(10) Patent No.: US 7,377,711 B2
(45) Date of Patent: May 27, 2008

(54) LIQUID COSMETIC CASE

(76) Inventor: Young Kwang Byun, 928-1005, Mok-dong Apt, 312, Shinjeong-dong, Yangcheon-ku, Seoul (KR) 158-769

( * ) Notice: Subject to any disclaimer, the term of this patent is extended or adjusted under 35 U.S.C. 154(b) by 0 days.

(21) Appl. No.: 11/269,537

(22) Filed: Nov. 9, 2005

(65) Prior Publication Data

US 2006/0140708 A1 Jun. 29, 2006

(30) Foreign Application Priority Data

Dec. 27, 2004 (KR) ..... 10-2004-0112884
Oct. 10, 2005 (KR) ..... 10-2005-0094842

(51) Int. Cl.
*A46B 17/04* (2006.01)
*A46B 11/04* (2006.01)

(52) U.S. Cl. ..... 401/269; 401/272; 401/280

(58) Field of Classification Search ..... 401/269, 401/270, 272, 280, 213, 202, 278
See application file for complete search history.

(56) References Cited

U.S. PATENT DOCUMENTS 3,400,997 A * 9/1968 Schwartzman ..... 401/186
4,902,152 A * 2/1990 Seidler ..... 401/117
5,230,579 A * 7/1993 Klawson et al. ..... 401/205
5,904,433 A * 5/1999 Kay ..... 401/269
6,854,914 B2 * 2/2005 Keating et al. ..... 401/270

* cited by examiner

*Primary Examiner*—David J. Walczak
(74) *Attorney, Agent, or Firm*—Birch, Stewart, Kolasch & Birch, LLP

(57) ABSTRACT

A liquid cosmetic case adapted to dispense a cosmetic material which includes a tube-shaped container adapted to house a cosmetic material, said container being provided at one end thereof with threaded walls which define an aperture; a cap provided with locking slots and threads for screw engagement with the threaded walls of said container; a discharger disposed within said aperture, said discharger containing liquid guiding passages which communicate at one end with the container and at the other end with a conduit provided in such discharger; and a support cap engaged with the upper external portion of said discharger for securing a brush to the discharger conduit, said support cap containing locking flanges which engage with said locking slots provided in said cap, whereby upon the engagement and disengagement between the cap and the discharger, the communication through said liquid guiding passes between said container and said conduit in the discharger can be opened or closed.

4 Claims, 10 Drawing Sheets

LIQUID COSMETIC CASE

CROSS-REFERENCE TO RELATED APPLICATIONS

This application claims the benefit of Korean Patent Applications No. 10-2004-0112884 and 10-2005-0094842, filed on Dec. 27, 2004 and Oct. 10, 2005, respectively in the Korean Intellectual Property Office, the disclosures of which are incorporated herein by reference.

BACKGROUND

1. Field of the Invention

The present invention relates to a liquid cosmetic case in which a supporting cap to which a brush is fixed is attached to the upper side of a tube-shaped container that stores liquid cosmetic and is coupled with a discharger which is closed after discharging the liquid cosmetic. The cap is thread-coupled with the upper side of the tube-shaped container so that the discharger coupled with the supporting cap ascends and descends by opening and closing the cap. When the cap ascends, a ring-shaped step in the upper end of a liquid supplying container is opened so that a through hole and a liquid guiding passage formed by an inner protrusion wheel step are connected to a discharge hole and that the liquid cosmetic in the tube-shaped container is discharged to the brush. When the cap descends, the ring-shaped step in the upper end of the liquid supplying container is pressed and closed so that the liquid cosmetic stored in the tube-shaped container does not leak and that a user can safely carry the liquid cosmetic case.

2. Discussion of Related Art

According to a conventional art, a screw rod with which a piston is thread-coupled to ascend and descend and in which a liquid cosmetic guiding passage is formed so that a ball for opening and closing the liquid cosmetic guiding passage is elastically supported by a spring in the liquid cosmetic guiding passage is provided in a container that stores the liquid cosmetic and is coupled with a body.

Therefore, according to the conventional art, a large number of parts are coupled with each other and the structure is complicated so that manufacturing expenses increase. Also, a user must hold the container and rotate the body several times during use, which is inconvenient.

SUMMARY OF THE INVENTION

In order to solve the above-described problems, it is an object of the present invention to provide a cosmetic case in which a supporting cap to which a brush is fixed is fixed to the upper side of a tube-shaped container that stores liquid cosmetic and is coupled with a discharger closed after discharging liquid cosmetic and a cap is thread-coupled with the upper side of the tube-shaped container so that the discharger coupled with the supporting cap ascends and descends by opening and closing the cap. When the cap ascends, a ring-shaped step in the upper end of a liquid supplying container is opened so that a through hole and a liquid guiding passage formed by an inner protrusion wheel step are connected to a discharge hole and that the liquid cosmetic in the tube-shaped container is discharged to the brush. When the cap descends, the ring-shaped step in the upper end of the liquid supplying container is pressed and closed so that the liquid cosmetic stored in the tube-shaped container does not leak and that a user can safely carry the cosmetic case. Since the cap is thread-coupled with the upper side of the tube-shaped container, it is possible to prevent the liquid cosmetic from leaking and from being contaminated.

BRIEF DESCRIPTION OF THE DRAWINGS

These and/or other objects and advantages of the invention will become apparent and more readily appreciated from the following description of preferred embodiments, taken in conjunction with the accompanying drawings of which.

DETAILED DESCRIPTION OF PREFERRED EMBODIMENTS

Figure 1:
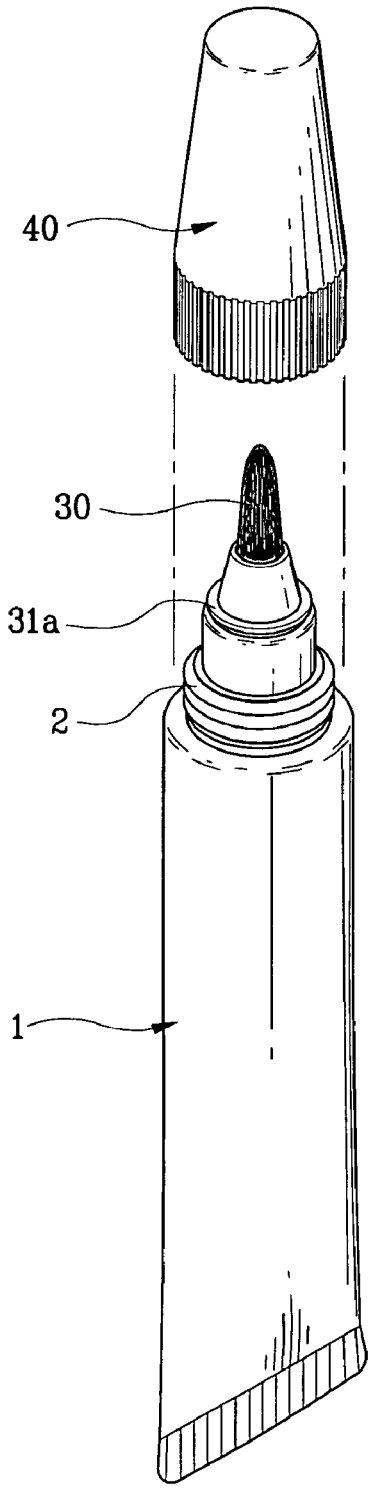
FIG. 1 is a perspective view of a cosmetic case according to the present invention whose cap is opened.
Figure 2:
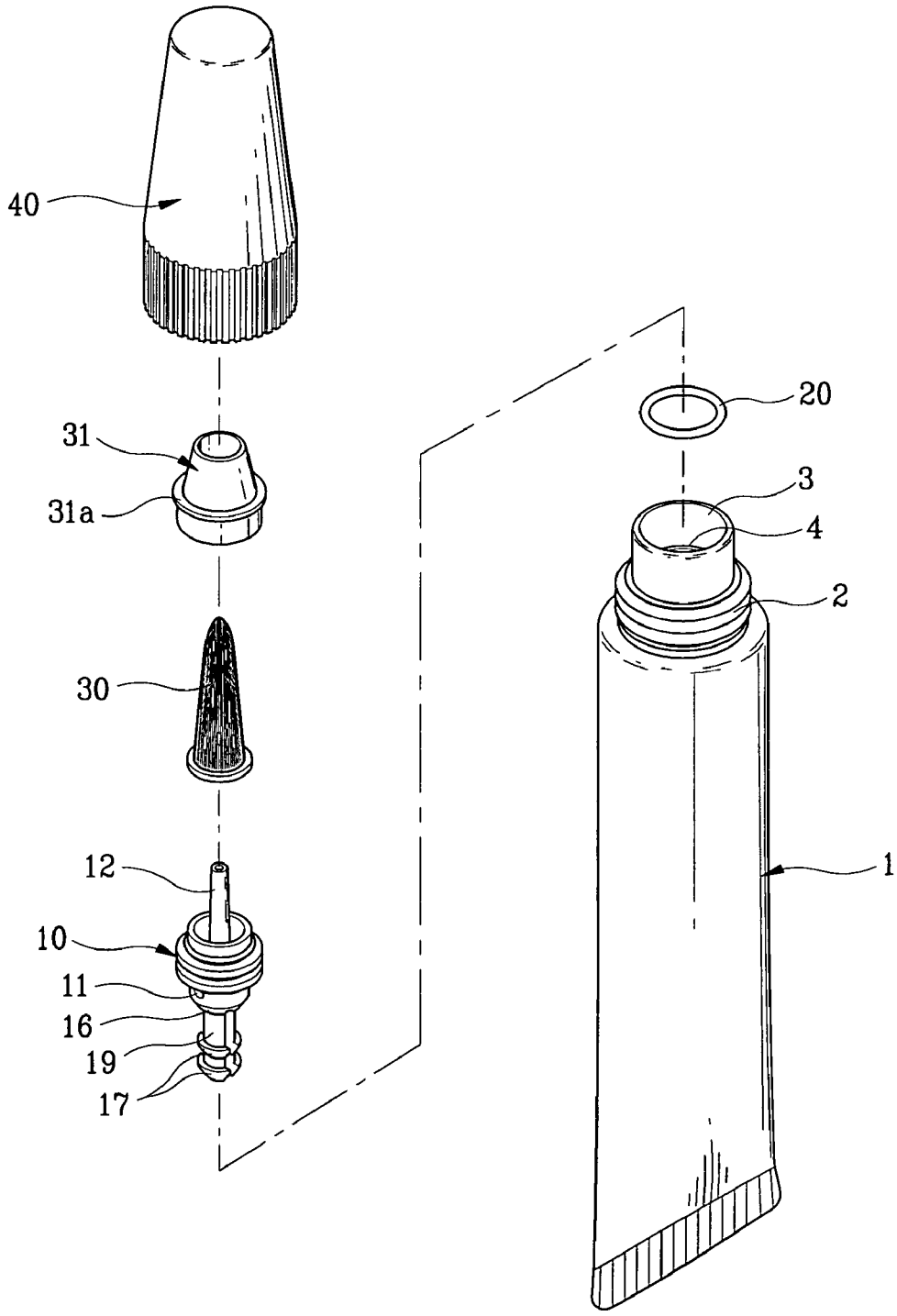
FIG. 2 is an exploded perspective view of the cosmetic case according to the present invention.

Hereinafter, preferred embodiments of the present invention will be described with reference to the accompanying drawings.

FIGS. 1 to 4 are exploded perspective views of a cosmetic case according to the present invention and sectional views illustrating the coupled state and the operation state of the cosmetic case according to the present invention.

An opening 3 is formed in the upper side of a male thread 2 provided on the outer circumference wall of a tube-shaped container 1 and a step 4 and a ring-shaped step 5 and an inner protruded wheel step 7 are formed on the inner circumference wall of the tube-shaped container 1 in the lower side of a liquid supplying container 6 so that an additional discharger 10 can be inserted to ascend and descend while being provided with a sealing O-ring 20.

A liquid guiding passage 11 is horizontally disposed in the center of the discharger 10 and is connected to a discharge conduit 12 which vertically penetrates the center of the discharger 10. A pressing plate 31*a* is formed on the circumference of a supporting cap 31 to which a brush 30 is fixed and a groove ring 33 is formed in the lower end and on the outer circumference wall of the discharger 10 so that the groove ring 33 is fixed to engage with the protrusion ring 13 provided on the inner circumference wall and in the upper side of the supporting cap 31.

A groove 14 into which the sealing O-ring 20 is inserted and a locking step 15 are formed on the outer circumference wall and in the upper side of the discharger 10. A structure containing slanted circumference walls 16 whose upper side is wide and whose lower side is narrow is formed below the liquid guiding passage 11. Stepped jaws 17 and 17*a* are formed in the lower end of the structure defining the slanted circumference walls 16, the upper side of which is wide and the lower side of which is narrow. A column 19 which supports the jaws 17 and 17*a* is provided with a divided opening 18 which supplies liquid cosmetic.

As described above, the supporting cap 31 to which the brush 30 is fixed is connected to the protrusion ring 13 of the discharger 10 and the discharger 10 which contains the sealing O-ring 20 provided in the groove 14 is inserted into the opening 3 of the tube-shaped container 1 such that the sealing O-ring 20 tightly seals the inner circumference wall of the opening 3. The locking step 15 of the discharger 10 engages the step formed on the inner circumference wall of the opening 3, whereby the slanted circumference wall 16 of the discharger 10 presses and closes the ring-shaped step 5 of the opening 3. The column 19 with the divided opening 18 extends through hole 7*a* formed by the inner protrusion wheel 7 disposed in the inner circumference wall and in the lower side of the tube-shaped container 1 to connect the liquid supplying container 6 to the inside of the tube-shaped container 1 through the divided opening 18.

As described above, a cap 40 is thread-coupled with the upper side of the tub-shaped container 1. A female thread 41 corresponding to the male thread 2 formed in the upper side and on the outer circumference wall of the tube-shaped container 1 is formed on the inner circumference wall and in the lower side of the cap 40, respectively, and a pressing step 42 and an inner locking wheel 43 are respectively formed on the inner circumference wall and in the center of the cap 40 so that the cap 40 is thread-coupled to the upper side of the tube-shaped container 1. Therefore, the pressing step 42 formed on the inner circumference wall of the cap 40 is fixed to the upper side of the discharger 10 to press against the pressing plate 31*a* locking flanges formed in the upper side of the supporting cap 31 to which the brush 30 is fixed and to have the discharger 10 descend. Therefore, the slanted circumference wall 16 whose upper side is wide and whose lower side is narrow formed at the outer circumference wall of the discharger 10, presses and closes the ring-shaped step 5 formed on the inner circumference wall and in the upper side of the tube-shaped container 1 to intercept the liquid supplying container 6 connected to the divided opening 18 and the liquid guiding passage 11 connected to a discharge hole 12.

In the above-described state, the pressing plate 31*a* is pressed by the pressing step formed on the inner circumference wall in the center of the cap 40 and locked by the inner locking wheel (locking slots) 43. When the cap 40 is rotated to be opened, the pressing plate 31*a* locked by the inner locking wheel 43 formed on the inner circumference wall and in the center of the cap 40 ascends to a predetermined height together with the cap 40 that ascends as it is rotated.

At this time, the discharger 10 coupled with the supporting cap 31 including the pressing plate 31*a* locking flanges ascends so that the slanted circumference wall 16 of the discharger 10 separates from the ring-shaped step 5 of the opening 3 to open the upper side of the liquid supplying container 6. Therefore, the through hole 7*a* formed by the inner protruded wheel step 7 formed on the inner circumference wall and in the lower end of the tube-shaped container 1 is connected to the liquid guiding passage 11 and the discharge hole 12 so that the liquid cosmetic in the tube-shaped container 1 can be discharged to the brush 30. Simply stated, as the cap is unscrewed, the stopped jaws will engage inner protrusion wheel 7 and the pressing plate 31*a* will snap out of a groove on the cap to enable the cap to be removed.

Figure 4:
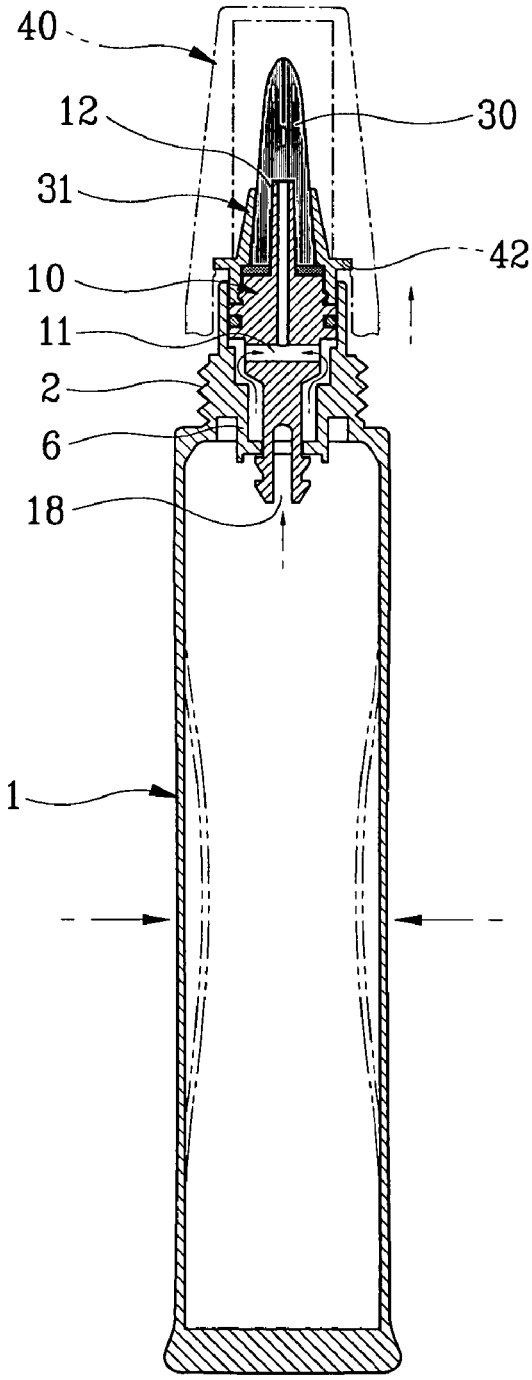
FIG. 4 is a sectional view illustrating an operation state of the cosmetic case according to the present invention.
Figure 5:
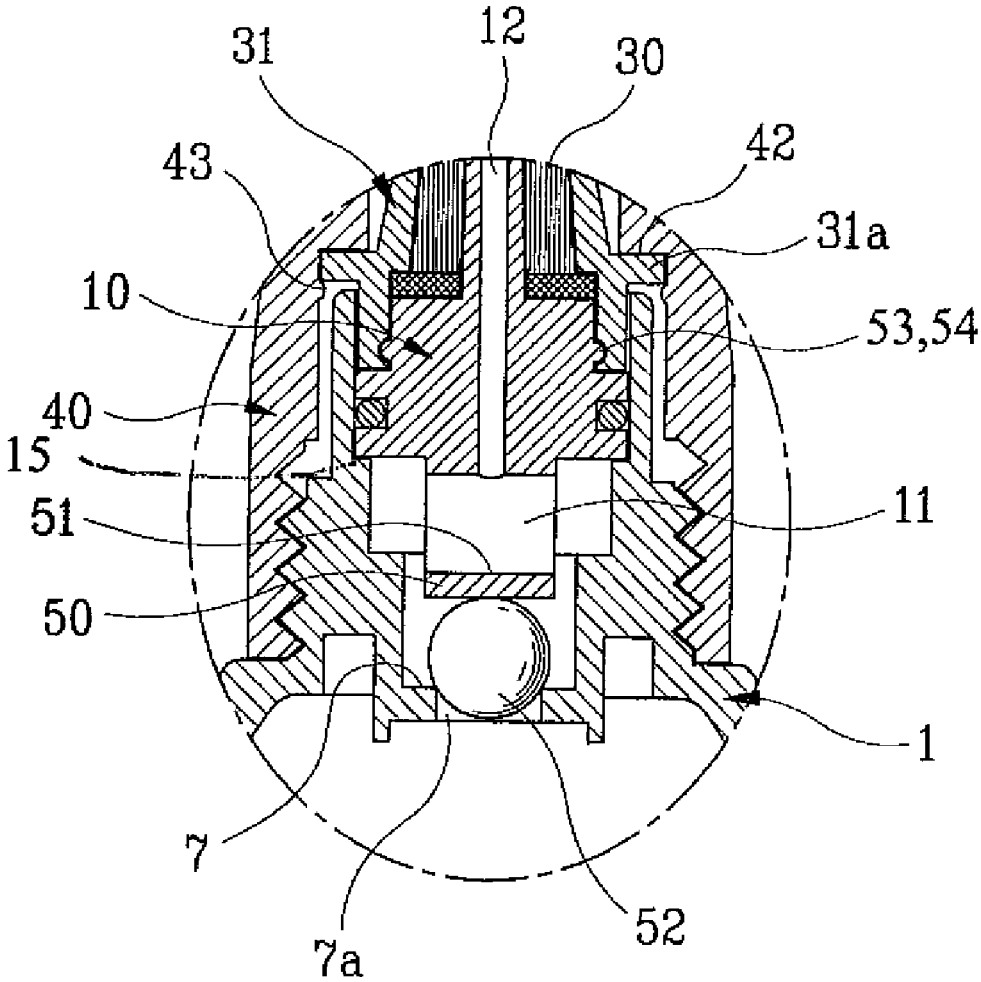
FIG. 5 is a sectional view of a cosmetic case according to a first embodiment of the present invention.
Figure 6:
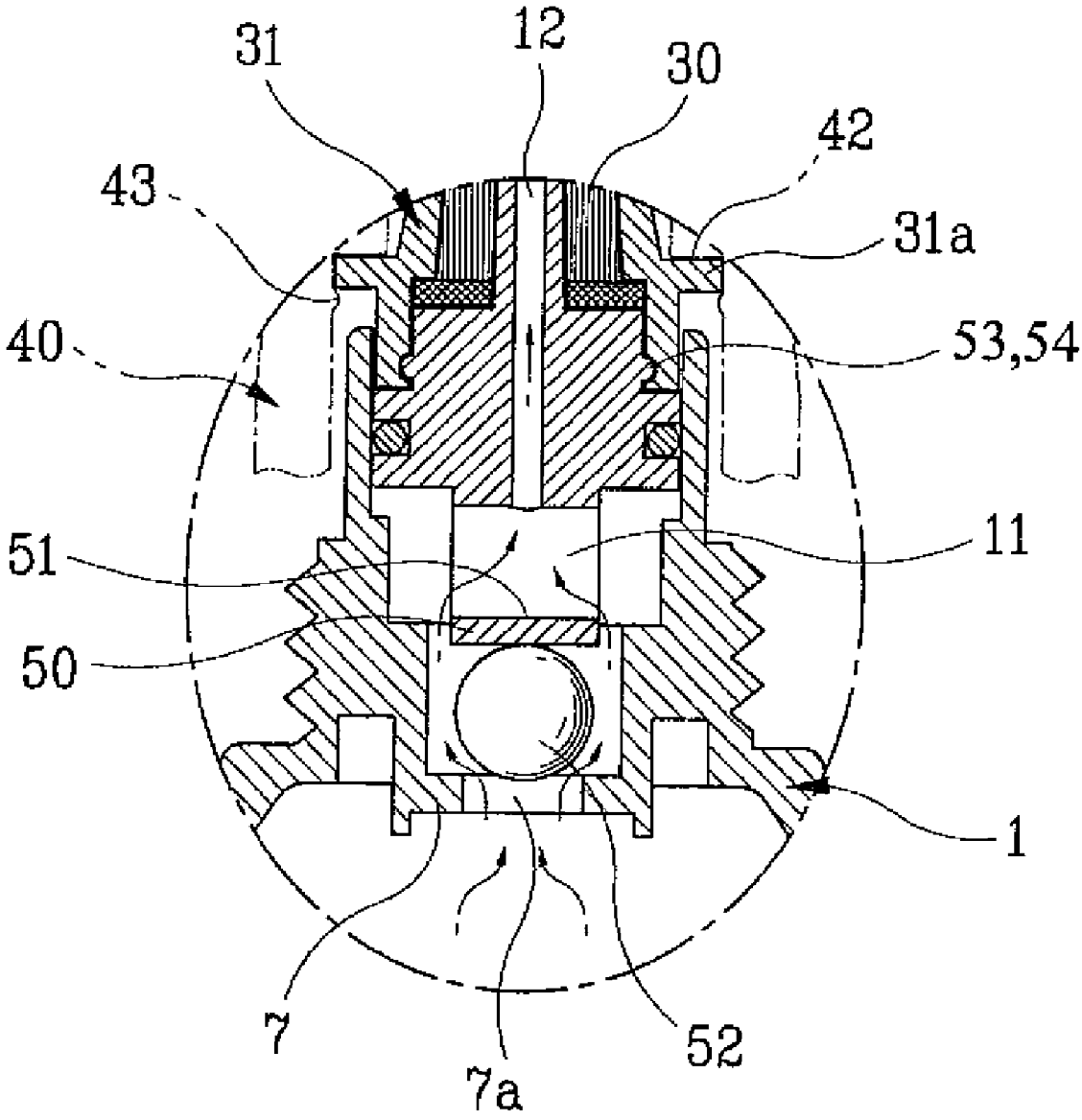
FIG. 6 is a sectional view illustrating the operation state of the cosmetic case of FIG. 5.

FIGS. 5 and 6 are sectional views illustrating a cosmetic case according to a first embodiment of the present invention. As described in the structure of the discharger 10 of FIGS. 1 to 4, the liquid guiding passage 11 connected to the discharge hole 12 is extended downward by the use of a supporting plate 50 having a bottom planar surface 51.

The supporting plate 50 is positioned to ascend and descend in the liquid supplying container 6. An opening and closing ball 52 is provided under the supporting plate 50 to open and close the through hole 7*a* formed by the inner protruded wheel step 7 of the liquid supplying container 6. An outer locking protrusion wheel 53 is provided on the outer circumference wall and in the lower end of the discharger 10 to which the brush 30 is fixed. An inner locking protrusion wheel 54 is provided on the inner circumference wall and in the upper end of the tube-shaped container 1 into which the discharger 10 is inserted to ascend and descend. The outer locking protrusion wheel 53 and the inner locking protrusion wheel 54 are coupled with each other so that the discharger 10 does not deviate when the tube-shaped container 1 is pressed.

Figure 7:
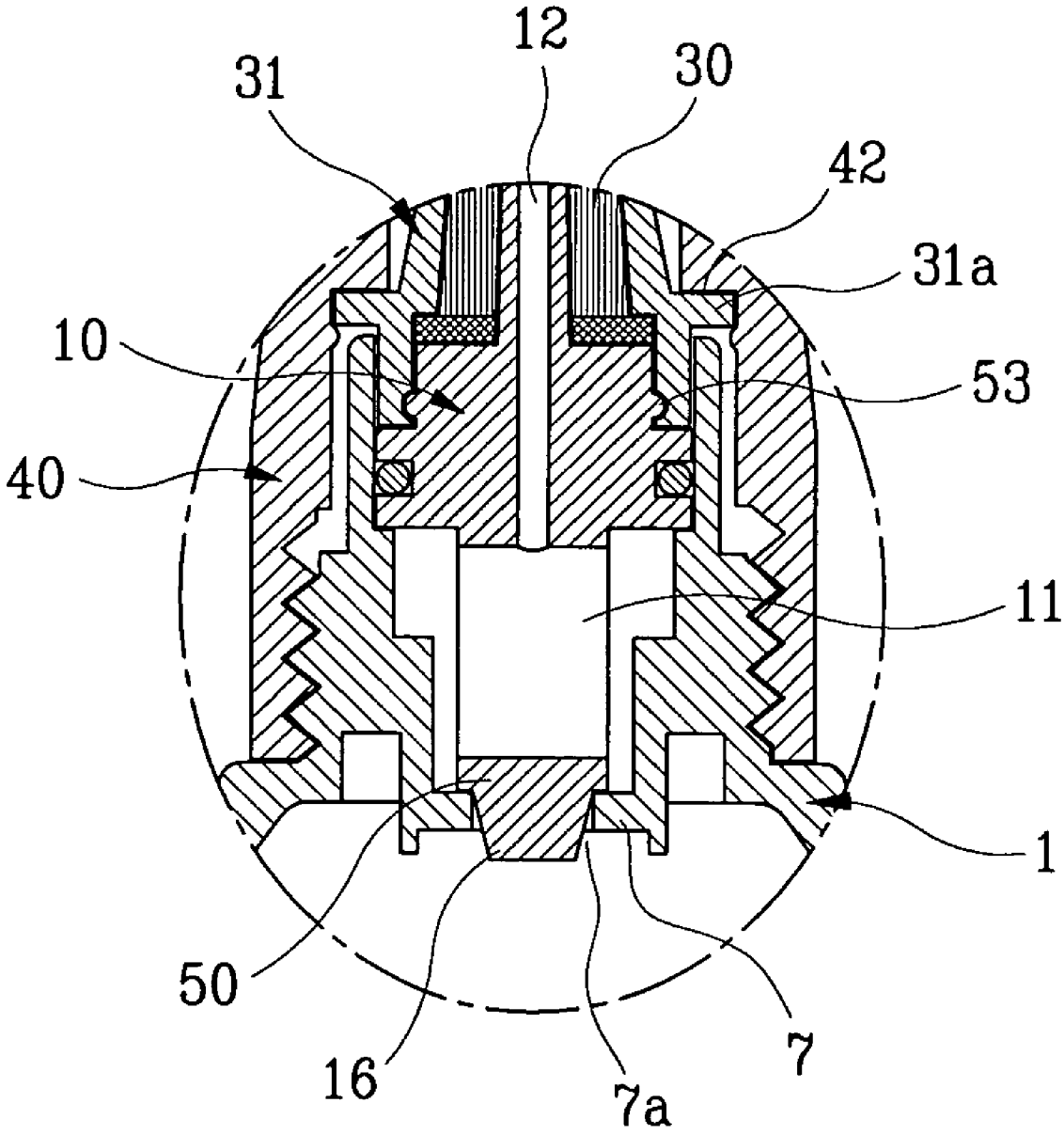
FIG. 7 is a sectional view of a cosmetic case according to a second embodiment of the present invention.
Figure 8:
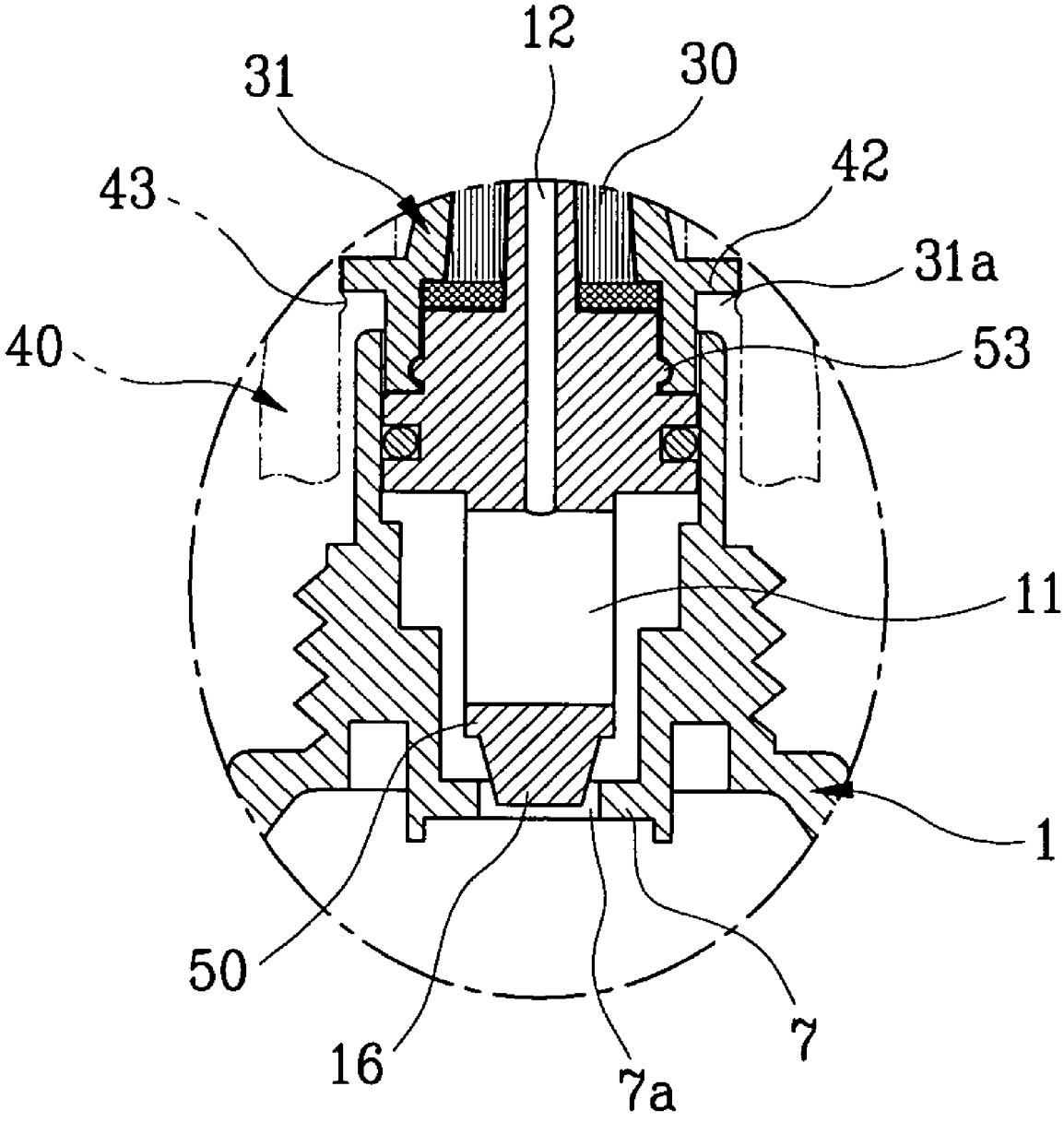
FIG. 8 is a sectional view of the main part of the operation state of the cosmetic case of FIG. 7.

FIGS. 7 and 8 are sectional views illustrating a cosmetic case according to a second embodiment of the present invention. As described with reference to the structure of the discharger 10 of FIGS. 1 to 6, the column 19 formed below the slanted circumference wall 16 defines the liquid guiding passage 11 connected to the discharge hole 12 said passage 11 being further defined by the supporting plate 50 formed by extending the liquid guiding passage 11 in the downward direction. Therefore, the through hole 7*a* formed by the inner protruding wheel step 7 that forms the liquid supplying chamber 6 is directly opened and closed.

Figure 3:
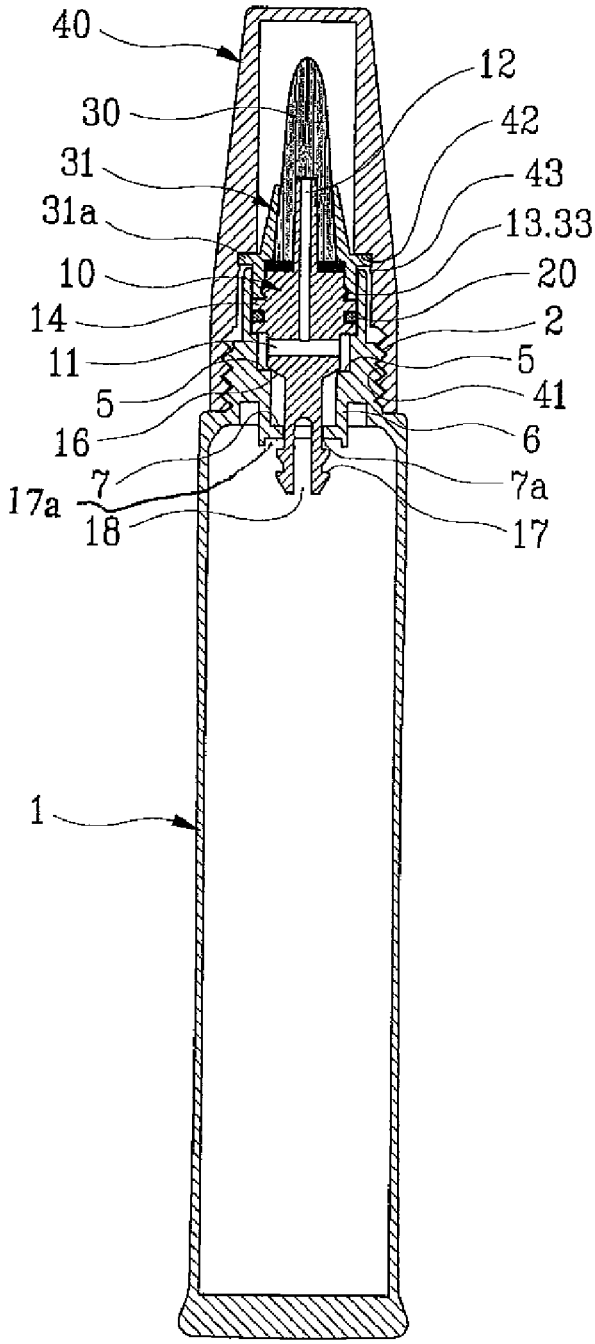
FIG. 3 is a sectional view of the cosmetic case according to the present invention.

In the state where the cap 40 is thread-coupled with the tube-shaped container 1, as illustrated in FIG. 3, the pressing plate 31*a* of the supporting cap 31 to which the brush 30 is attached engaged with the upper side of the discharger 10 by the pressing step 42 formed at the inner circumference wall in the upper side of the cap 40 so that as the discharger 10 descends, the slanted circumference wall 16 presses and seals up the ring-shaped step 5 of the tube-shaped container 1. Therefore, it is possible to safely carry the cosmetic case without the danger of the liquid cosmetic stored in the tube-shaped container 1 leaking to the outside.

Figure 9:
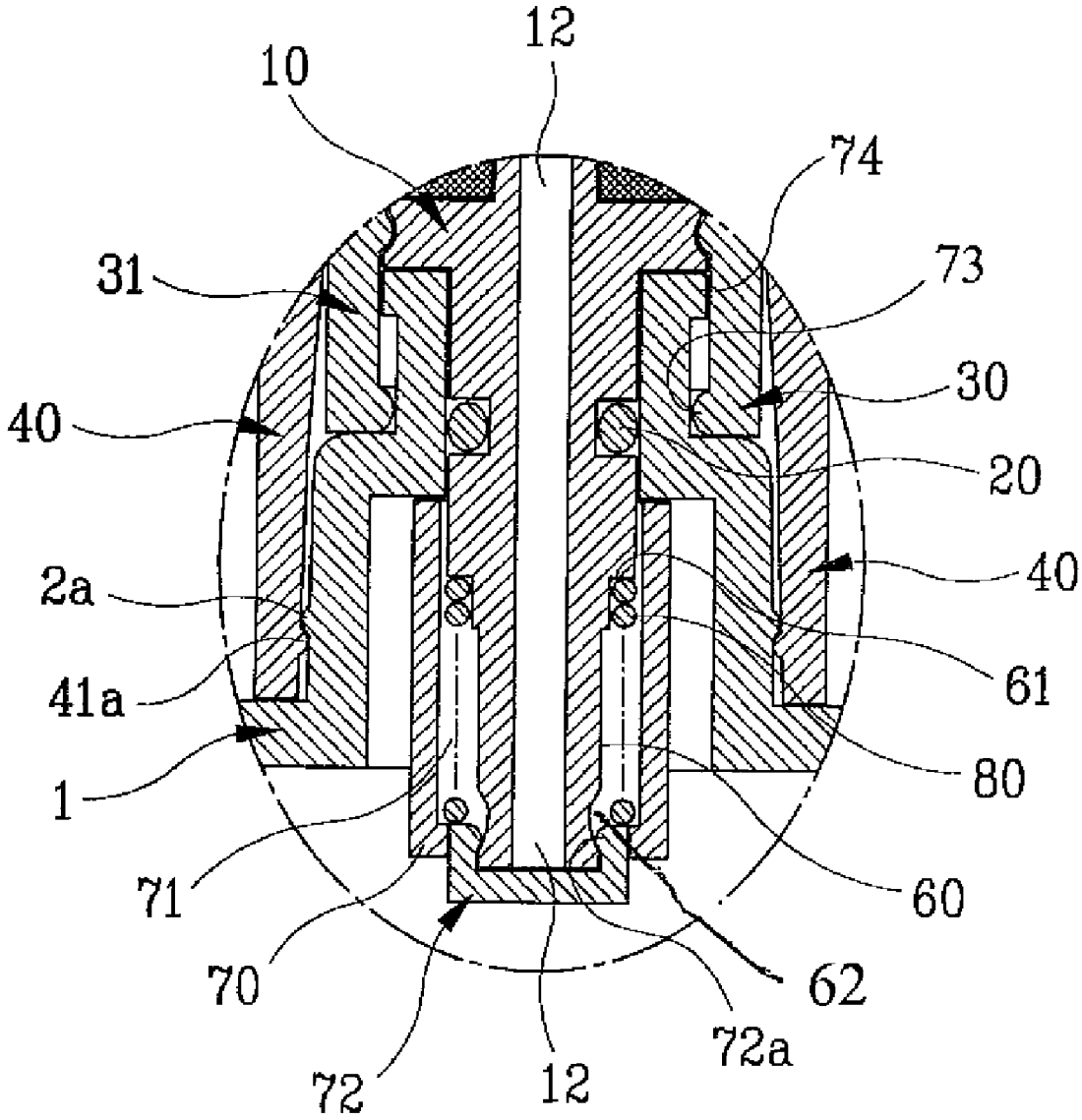
FIG. 9 is a sectional view of a cosmetic case according to a third embodiment of the present invention.
Figure 10:
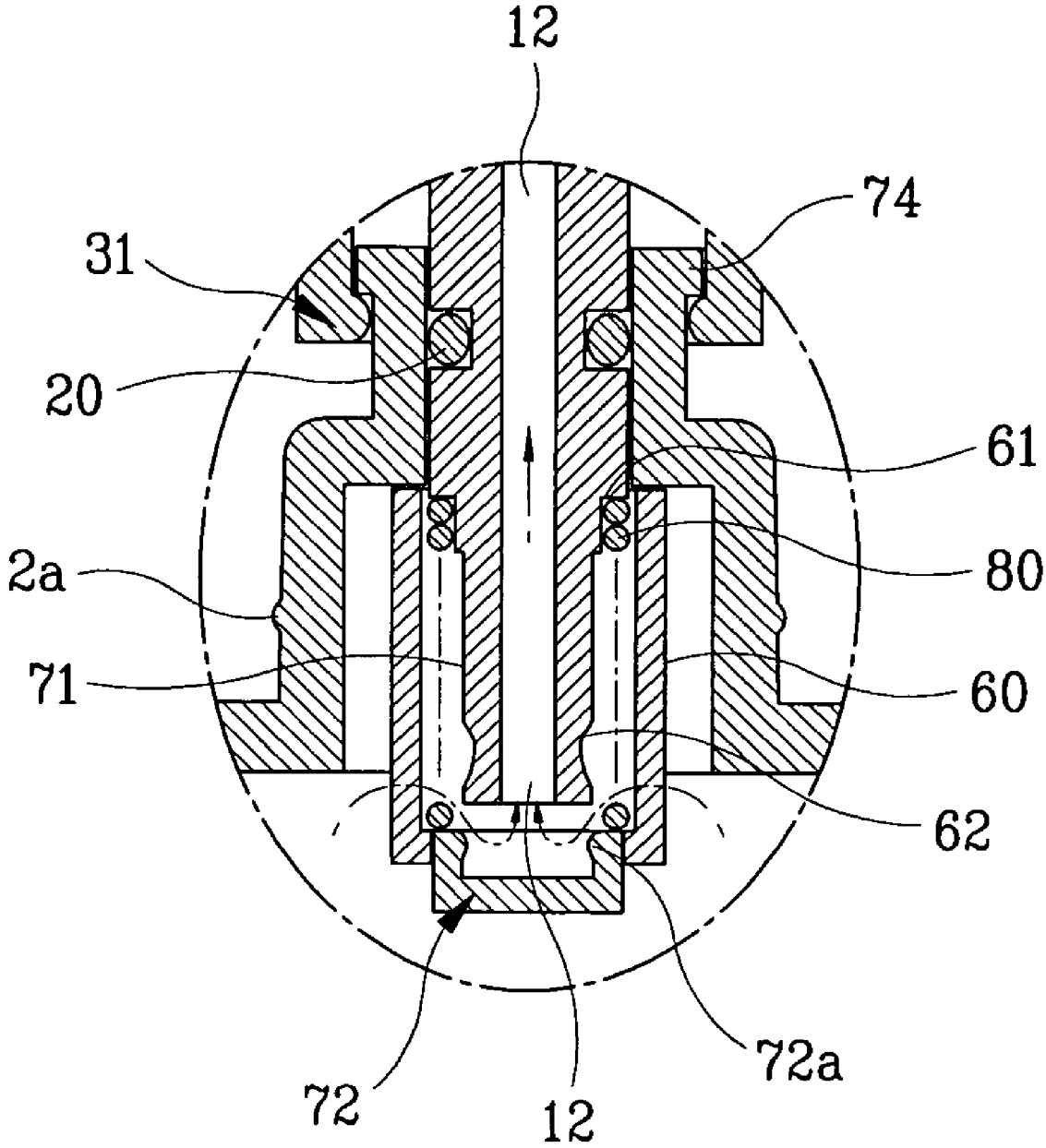
FIG. 10 is a sectional view of the main part of the operation state of the cosmetic case of FIG. 9.

FIGS. 9 and 10 are sectional views illustrating a cosmetic case according to a third embodiment of the present invention. By the male threads 2 of the upper outer circumferential wall of the tube-shaped container 1 of FIGS. 1 to 8, and by the outer protruding ring 2*a* of the tube-shaped container 1, and an inner protruding ring 41*a* of the cap 40, the cap 40 on the top of the tub-shaped container 1 can be forcibly opened without female treads 41 formed in the lower inner circumferential wall of the cap 40. Moreover, without the liquid guiding passage 11 formed in the center of the discharge hole 12, a vertical body 60 which is a vertical extension of the discharge hole 12, is formed. Corresponding to the structure of an upper step 61 formed in the upper side of the vertical body 60, a groove ring 62 is formed in the lower side of the outer circumferential wall of the vertical body 60 and several erected pieces 70 are formed in the upper inner circumferential wall of the tube-shaped container 1 to open the circumference of the liquid supplying container 6 such that a liquid supplying chamber 71 is formed. A through-hole 7*a* formed in the lower end is closed such that an opening and closing cap 72, in which the inner protruding ring 72*a* is formed in correspondence to the groove ring 62 of the vertical body 60, is formed in the upper side of the inner circumferential wall to open and close the discharge hole 12 formed in the vertical body 60. An elastic spring 80 is disposed between the upper step 61 of the vertical body 60 and the opening and closing cap 72 such that the opening and closing cap 72 is safely operated by the erected pieces 70 for defining the liquid supplying chamber 71. An inner locking protruding wheel 73 is formed in the inner lower circumferential wall of the supporting cap 31 and is engaged with the upper side of the discharger 10 to cover the supporting cap 31. An outer locking protruding wheel 74 is formed in the upper side of the outer circumferential wall of the tube-shaped container 1 and is engaged with the inner locking protruding wheel 73 such that the discharger 10 is not separated when pressing the tube-shaped container 1.

In the liquid cosmetic case according to the preferred embodiment of the present invention as described above, the state of the cap 40 being thread-coupled with the tube-shaped container 1, as shown in FIG. 1, is the state in which the pressing plate 31*a* of the supporting cap 31 is pressed by the pressing step 42 formed in the upper side of the inner circumferential wall of the cap 40 such that the slanted circumference wall 16 presses and closes the ring-shaped step 5 of the tube-shaped container 1. Thus, the liquid cosmetic stored in the tube-shaped container 1 does not leak and is safely stored.

When using the liquid cosmetic case according to the preferred embodiment of the present invention, as shown in FIG. 4, the cap 40 thread-coupled with the upper side of the tube-shaped container 1 is turned to open the tube-shaped container 1. At that time, as the pressing plate 31*a*, locked to the inner locking wheel 43 formed in the center of the inner circumferential wall of the cap 40, is rotated to ascend to a predetermined height together with the ascending cap 40, the discharger 10 coupled with the supporting cap 31 in which the pressing plate 31*a* is formed also ascends together them so that the slanted circumference wall 16 of the discharger 10 is separated from the ring-shaped step 5 of the opening 3 and the upper side of the liquid supplying container 6 is opened. The divided opening 18 of the discharger 10, the liquid supplying container 6, the liquid guiding passage 11, and the discharge hole 12 all communicate with each other such that when the tube-shaped container 1 is held by hand and pressed, the liquid cosmetic stored in the tube-shaped container 1 is discharged and impregnated into the brush 30.

When the discharger 10 ascends due to the pressing of the tube-shaped container 1, the stepped jaws 17 and 17*a* formed in the lower sides of the divided opening 18 are obstructed by the inner protruding wheel step 7 forming the through hole 7*a* so that the discharger 10 does not excessively ascend.

Moreover, as shown in FIGS. 5 and 6 illustrating the first preferred embodiment of the present invention, in the state of opening the through-hole 7*a* due to the pressure generated by opening the cap 40 thread-coupled with the tube-shaped container 1 and pressing the tube-shaped container 1, the opening and closing ball 52 ascends and the tube-shaped container 1 communicates with the liquid supplying container 6, the liquid guiding passage 11, and the discharge hole 12 through the through-hole 7*a* such that the liquid cosmetic stored in the tube-shaped container 1 is discharged through the discharge hole 12 and is impregnated into the brush 30.

By repeating the above actions, the liquid cosmetic stored in the tube-shaped container 1. At that time, the outer locking protrusion wheel 53 of the supporting cap 31 fixed to the upper side of the discharge 10 is locked to the inner locking protrusion wheel 54 formed in the upper side of the inner circumference wall of the opening 3 so that ring the discharger 10 is not separated and is safely used.

As shown in FIGS. 7 and 8 illustrating the second preferred embodiment of the present invention, the discharger 10 ascends, as shown in FIG. 7, due to the pressure generated in the tube-shaped container 1 by opening the cap 40 thread-coupled with the tube-shaped container 1 and pressing the tube-shaped container 1, and the slanted circumference wall 16 for closing the through-hole 7*a* formed by the inner protruded wheel step 7 ascends such that the through-hole 7*a*, the liquid guiding passage 11, and the discharge hole 12 communicate with each other so that the liquid cosmetic stored in the tube-shaped container 1 is discharged through the discharge hole 12 and is impregnated into the brush 30.

After use, the cap 40 is thread-coupled with the upper side of the tube-shaped container 1 such that the slanted circumference wall 16 securely closes the through-hole 7*a* so that the liquid cosmetic stored in the tube-shaped container 1 is prevented from leaking.

As shown in FIGS. 9 and 10 illustrating the third preferred embodiment of the present invention, when opening the cap 40 thread-coupled with the tube-shaped container 1, the pressing step 42 formed in the central portion of the inner circumference wall of the cap 40 releases the pressing plate 31*a* engaged with the upper side of the discharger 10 and is elastically supported by the upper step 61 of the vertical body 60 of the discharger 10 and the upper side of the opening and closing cap 72 such that the discharger 10 ascends due to the elastic force of the elastic spring 60 installed between the circumference of the vertical body 60 and the erected pieces 70. At this time, the lower side of the discharge hole 12 pressing and closing the lower side of the vertical body 60 is opened such that the tube-shaped container 1 communicates with the discharge hole 12 by the communication of the several erected pieces 70 with the discharge hole 12.

Thus, due to the pressure generated by pressing the tube-shaped container 1, the liquid cosmetic stored in the tube-shaped container 1 is discharged and impregnated into the brush 30.

As such, after using the brush 30 into which the liquid cosmetic is impregnated, the cap 40 is again thread-coupled with the upper side of the tube-shaped container 1 such that the pressing step 42 of the cap 40 presses the pressing plate 31*a* of the supporting cap 31 engaged with the upper side of the discharger 10 and the lower side of the vertical body 60 contacts the inner bottom of the opening and closing cap 72 so that the inner protruding ring 72*a* in the inner circumference wall of the opening and closing cap 72 is engaged with the groove ring 62 formed in the outer circumference wall of the vertical body 60. Thus, the tube-shaped container 1 and the discharge hole 12 are securely pressed and closed.

At this time, since the elastic spring 80 is elastically pressed between the upper step 61 of the vertical body 60 and the upper circumference of the opening and closing cap 72, the liquid cosmetic stored in the tube-shaped container 1 does not leak and is safely stored.

Therefore, the liquid cosmetic case according to the preferred embodiments of the present invention is structured such that the discharger 10 coupled with the supporting cap 31 automatically ascends and descends due to the opening and closing of the cap 40. When the cap 40 ascends, the ring-shaped step 5 as the upper side of the liquid supplying container 6 is opened such that the through-hole 7*a* defined by the inner protruding wheel step 7, the liquid guiding passage 11, and the discharge hole 12, communicate with each other so that the liquid cosmetic in the tube-shaped container 1 is discharged to the brush 30. When the cap 40 descends, since the ring-shaped step 5 as the upper side of the liquid supplying container 6 is pressed and closed, the liquid cosmetic stored in the tube-shaped container 1 does not leak and is safely stored.

As described above, the supporting cap, in which the brush is attached, is fixed to the upper side of the tube-shaped container for storing the liquid cosmetic and the discharger for discharging the liquid cosmetic is coupled with the upper side of the tube-shaped container such that the cap is thread-coupled with the tube-shaped container so that the discharger coupled with the supporting cap automatically ascends and descends due to the opening and closing of the cap. Thus, when the cap ascends, the ring-shaped step as the upper side of the liquid supplying container is opened such that the through-hole formed by the inner protruding wheel step, the liquid guiding passage, and the discharge hole communicate with each other so that the liquid cosmetic in the tube-shaped container is discharged to the brush. When the cap descends, and the ring-shaped step as the upper side of the liquid supplying container is pressed and closed, the liquid cosmetic stored in the tube-shaped container does not leak and is safely stored. When using the liquid cosmetic case, since a desired amount of the liquid cosmetic is easily discharged by repeatedly pressing the tube-shaped container by the user, loss of the liquid cosmetic can be prevented.

Although a few embodiments of the present invention have been shown and described, it would be appreciated by those skilled in the art that changes might be made in this embodiment without departing from the principles and spirit of the invention, the scope of which is defined in the claims and their equivalents.

What is claimed is:

1. A liquid cosmetic case adapted to dispense a cosmetic material which comprises:

a tube-shaped container adapted to house a cosmetic material, said container being provided at one end thereof with threaded walls which define an aperture, a cap provided with locking slots and threads for screw engagement with the threaded walls of said container, a discharger disposed within said aperture, said discharger containing liquid guiding passages defined by said discharger, and liquid guiding passages communicating at one end with the container and at the other end with a conduit provided in such discharger, a brush supported by said discharger at said other end, a support cap engaged with an upper external portion of said discharger for securing the brush to the discharger conduit, said support cap containing locking flanges which engage with said locking slots provided in said cap, whereby upon the engagement and disengagement between the cap and the support cap, the discharger is caused to move within said aperture whereby the communication through said liquid guiding passages between said container and said conduit in the discharger can be opened or closed.

2. The liquid cosmetic case of claim 1, wherein the support cap has a tapered end which surrounds the conduit in the discharger to define a space therebetween, said brush being disposed within said space.

3. The liquid cosmetic case adapted to dispense a cosmetic material of claim 1, wherein an internal circumferential wall of said aperture is provided with a ring-shaped step and the discharger is provided with a circumferential wall, whereby the movement of the circumferential wall of the discharger relative to said ring-shaped step creates the liquid guide passages which provides communication between said container and the brush.

4. The liquid cosmetic case adapted to dispense a cosmetic material of claim 3, wherein the circumferential wall has a slanted configuration.

* * * * *